US006236620B1

(12) United States Patent
Schultz et al.

(10) Patent No.: US 6,236,620 B1
(45) Date of Patent: May 22, 2001

(54) INTEGRATED WELL DRILLING AND EVALUATION

(75) Inventors: Roger L. Schultz, Stillwater, OK (US); H. Kent Beck, Copper Canyon, TX (US); Paul D. Ringgenberg, Carrollton, TX (US); J. Allan Clark, Southlake, TX (US); Kevin R. Manke, Flower Mound, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 08/757,150

(22) Filed: Nov. 27, 1996

Related U.S. Application Data

(63) Continuation of application No. 08/292,341, filed on Aug. 15, 1994, now abandoned.

(51) Int. Cl.[7] ..... G01V 1/40; E21B 23/06

(52) U.S. Cl. ..... 367/82; 175/48; 175/50

(58) Field of Search ..... 367/81–85; 175/48, 175/50; 324/356, 369

(56) References Cited

U.S. PATENT DOCUMENTS

| | | | | |
|---|---|---|---|---|
| 2,819,038 | | 1/1958 | Eckel | 255/1.4 |
| 2,978,046 | | 4/1961 | True | 175/233 |
| 3,964,556 | * | 6/1976 | Gearhart et al. | 175/45 |
| 4,142,594 | | 3/1979 | Thompson et al. | 175/59 |
| 4,317,490 | | 3/1982 | Milberger et al. | 175/20 |
| 4,498,536 | | 2/1985 | Ross et al. | 166/250 |
| 4,550,392 | * | 10/1985 | Mumby | 367/82 |
| 4,566,535 | * | 1/1986 | Sanford | 166/250 |
| 4,589,485 | * | 5/1986 | Wrey | 166/250 |
| 4,790,378 | | 12/1988 | Montgomery et al. | 166/66 |
| 4,962,815 | * | 10/1990 | Schultz et al. | 166/25 |
| 5,008,664 | * | 4/1991 | More et al. | 175/40 |
| 5,287,741 | * | 2/1994 | Schultz et al. | 166/155 |
| 5,343,963 | * | 9/1994 | Bouldin et al. | 175/40 |

OTHER PUBLICATIONS

Article entitled New Formation Evaluation Tools And Interpretation Methods: A Review, by W. E. Preeg, Proceedings of the 14th World Petroleum Congress, 1994.

Article entitled "Advances in MWD technology improve real time data" by Trevor Burgess and Bernard Voisin, *Oil & Gas Journal*, Feb. 17, 1992.

Article entitled "Horizontal Drilling With Coiled Tubing Gains Momentum" by Jeff Littleton, *Petroleum Engineer International*, Jul., 1992.

Article entitled "Coiled tubing used for slim hole re–entry" by Eric Traonmilin and Ken Newman, *Oil& Gas Journal*, Feb. 17, 1992.

Article entitled "IFP field tests its new Trafor MWD system" by J. Guesnon and G. Pignard, *Ocean Industry*, Apr./May, 1992.

Desbrandes et al, Petroleum Engineer Int., 6/89, pp46–50.*

* cited by examiner

*Primary Examiner*—Nelson Moskowitz
(74) *Attorney, Agent, or Firm*—William M. Imwalle; Paul I. Herman; Neal R. Kennedy

(57) ABSTRACT

Integrated drilling and evaluation systems and methods for drilling, logging and testing wells are provided. The drilling and evaluation systems are basically comprised of a drill string, a drill bit carried on a lower end of the drill string for drilling a well bore, logging while drilling means included in the drill string for identifying subsurface zones or formations of interest, packer means carried on the drill string above the drill bit for sealing a zone or formation of interest below the packer means, and a fluid testing means included in the drill string for controlling the flow of well fluid from the zone or formation of interest into the drill string. The drilling and evaluation systems and methods for using the systems allow one or more subsurface zones or formations of interest in a well to be drilled, logged and tested without the necessity of removing the drill string from the well.

54 Claims, 4 Drawing Sheets

INTEGRATED WELL DRILLING AND EVALUATION

This is a continuation of application(s) Ser. No. 08/292,341 filed on Aug. 15, 1994, now abandoned.

BACKGROUND OF THE INVENTION

1. Field of the Invention

The present invention relates generally to the drilling of oil and gas wells, and more particularly, to systems and methods for drilling well bores and evaluating subsurface zones of interest as the well bores are drilled into such zones.

2. Description of the Prior Art

During the drilling and completion of an oil and/or gas well, it is usually necessary to test and evaluate the production capabilities of the well. This is typically done by isolating a subsurface zone or formation of interest therein which is to be tested and subsequently flowing well fluid either into a sample chamber or up through a tubing string to the surface. Various data such as pressure and temperature of the produced well fluids may be monitored downhole to evaluate the long term production characteristics of the zone or formation.

One very commonly used well testing procedure is to first cement a casing in the well bore and then to perforate the casing adjacent one or more zones of interest. Subsequently, the well is flow tested through the perforations. Such flow tests are commonly performed with a drill stem test string which is a string of tubing located within the casing. The drill stem test string carries packers, tester valves, circulating valves and the like to control the flow of fluids through the drill stem test string.

Typical tests conducted with a drill stem test string are known as draw-down and build-up tests. For the "draw-down" portion of the test, the tester valve is opened and the well is allowed to flow up through the drill string until the formation pressure is drawn down to a minimum level. For the "build-up" portion of the test, the tester valve is closed and the formation pressure is allowed to build up below the tester valve to a maximum pressure. Such draw-down and build-up tests may take many days to complete.

There is a need for quick, reliable testing procedures which can be conducted at an early stage in the drilling of a well before casing has been set. This is desirable for a number of reasons. First, if the well is a commercially unsuccessful well, then the cost of casing the well can be avoided or minimized. Second, it is known that damage begins occurring to a subsurface producing zone or formation as soon as it is intersected by the drilled well bore, and thus, it is desirable to conduct testing at as early a stage as possible.

While techniques and systems have been developed for testing open, uncased well bores, it is often considered undesirable to flow test an open hole well through a drill stem test string from the standpoint of safety considerations. That is, the conduct of conventional draw-down and build-up testing in an open hole situation is dangerous in that the drill pipe is full of drilling mud which must be circulated out and it is possible for problems to occur such as blow-outs or differential pressure sticking of the pipe. It is preferable to conduct a test with a safe dead well which is completely kept under control due to the continuous presence of a column of heavy drilling mud therein.

One technique that has been used is to pull the drill pipe out of the well bore when it is desired to test a subterranean zone or formation penetrated by the well bore and to then run a special test string into the well for testing the zone or formation. This, of course, involves the time and cost of pulling and running pipe and is disadvantageous from that standpoint.

Thus, there is a need for integrated well drilling and testing systems and methods whereby subterranean zones of interest can be tested as the well bore is drilled into the zones to thereby quickly and inexpensively evaluate the production capability of the zones without substantially interrupting the drilling process.

SUMMARY OF THE INVENTION

The present invention provides integrated drilling and production evaluation systems and methods which overcome the shortcomings of the prior art and meet the needs described above. The methods and systems allow a variety of tests to be conducted during the drilling process including production flow tests, production fluid sampling, determining the subsurface zone or formation pressure, temperature and other conditions, etc.

The integrated well drilling and evaluation systems of this invention are basically comprised of a drill string, a drill bit carried on a lower end of the drill string for drilling a well bore, a logging while drilling instrument included in the drill string for generating data indicative of the hydrocarbon productive nature of subsurface zones and formations intersected by the well bore so that a zone or formation of interest may be identified without removing the drill string from the well bore, a packer carried on the drill string above the drill bit for sealing the zone or formation of interest between the drill string and the well bore, and a testing means included in the drill string which includes a valve for isolating and testing the zone or formation of interest, whereby the well can be drilled, logged and tested without removing the drill string from the well bore.

The methods of the present invention basically comprise the steps of drilling a well bore with the integrated drilling and evaluation string described above, logging the well bore with the logging while drilling instrument included in the drill string to thereby determine the presence and location of a subsurface zone or formation of interest, setting the packer in the well bore above the subsurface zone or formation of interest and sealing the zone or formation between the drill string and the well bore, and testing the zone or formation of interest by sampling the well fluids produced from the zone or formation, determining the pressure, temperature and other conditions of the zone or formation, flowing produced fluids to the surface and the like as will be described further herein.

It is, therefore, a general object of the present invention to provide integrated well drilling and evaluation systems and methods for identifying and testing subsurface zones or formation of interest as a well bore is being drilled.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIGS. 1A–1D provide a sequential series of illustrations in elevation which are sectioned, schematic formats showing the drilling of a well bore and the periodic testing of zones or formations of interest therein in accordance with the present invention.

DESCRIPTION OF PREFERRED EMBODIMENTS

Figures 1, 1C, 1D, 1E:
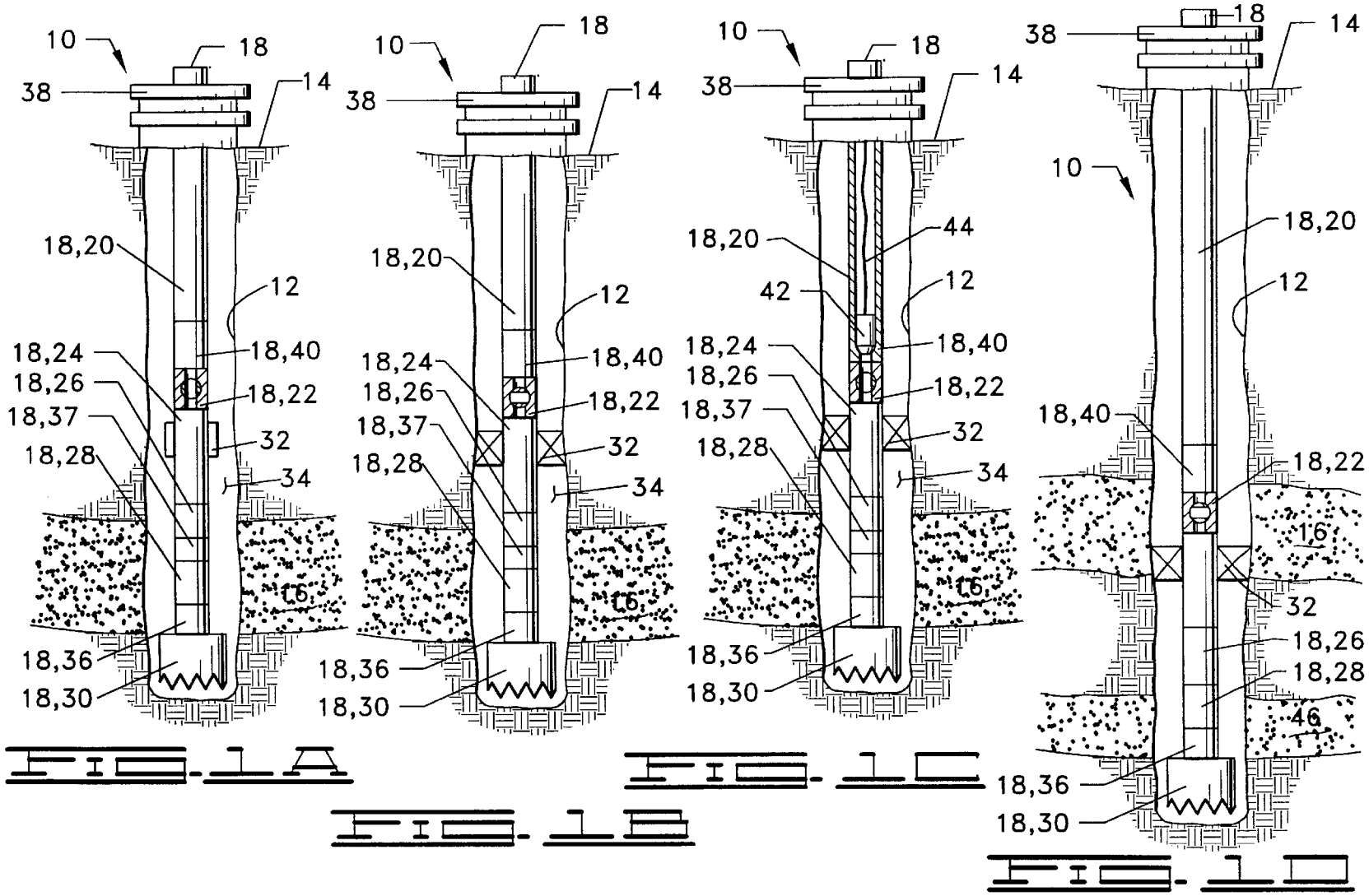

Referring now to the drawings, and particularly to FIGS. 1A–1D, the apparatus and methods of the present invention are schematically illustrated.

A well 10 is defined by a well bore 12 extending downwardly from the earth's surface 14 and intersecting a first subsurface zone or formation of interest 16. A drill string 18 is shown in place within the well bore 12. The drill string 18 basically includes a coiled tubing or drill pipe string 20, a tester valve 22, packer means 24, a well fluid condition monitoring means 26, a logging while drilling means 28 and a drill bit 30.

The tester valve 22 may be generally referred to as a tubing string closure means for closing the interior of drill string 18 and thereby shutting in the subsurface zone or formation 16.

The tester valve 22 may, for example, be a ball-type tester valve as is illustrated in the drawings. However, a variety of other types of closure devices may be utilized for opening and closing the interior of drill string 18. One such alternative device is illustrated and described below with regard to FIG. 5. The packer means 24 and tester valve 22 may be operably associated so that the valve 22 automatically closes when the packer means 24 is set to seal the uncased well bore 12. For example, the ball-type tester valve 22 may be a weight set tester valve and have associated therewith an inflation valve communicating the tubing string bore above the tester valve with the inflatable packer element 32 when the closure valve 22 moves from its open to its closed position. Thus, upon setting down weight to close the tester valve 22, the inflation valve communicated with the packer element 32 is opened and fluid pressure within the tubing string 20 may be increased to inflate the inflatable packer element 32. Other arrangements can include a remote controlled packer and tester valve which are operated in response to remote command signals such as is illustrated below with regard to FIG. 5.

As will be understood by those skilled in the art, various other arrangements of structure can be used for operating the tester valve 22 and packer element 24. For example, both the valve and packer can be weight operated so that when weight is set down upon the tubing string, a compressible expansion-type packer element is set at the same time that the tester valve 22 is moved to a closed position.

The packer means 24 carries an expandable packer element 32 for sealing a well annulus 34 between the tubing string 18 and the well bore 12. The packing element 32 may be either a compression type packing element or an inflatable type packing element. When the packing element 32 is expanded to a set position as shown in FIG. 1B, it seals the well annulus 34 therebelow adjacent the subsurface zone or formation 16. The subsurface zone or formation 16 communicates with the interior of the testing string 18 through ports (not shown) present in the drill bit 30.

The well fluid condition monitoring means 26 contains instrumentation for monitoring and recording various well fluid parameters such as pressure and temperature. It may for example be constructed in a fashion similar to that of Anderson et al., U.S. Pat. No. 4,866,607, assigned to the assignee of the present invention. The Anderson et al. device monitors pressure and temperature and stores it in an on board recorder. That data can then be recovered when the tubing string 18 is removed from the well. Alternatively, the well fluid condition monitoring means 26 may be a Halliburton RT-91 system which permits periodic retrieval of data from the well through a wire line with a wet connect coupling which is lowered into engagement with the device 26. This system is constructed in a fashion similar to that shown in U.S. Pat. No. 5,236,048 to Skinner et al., assigned to the assignee of the present invention. Another alternative monitoring system 26 can provide constant remote communication with a surface command station (not shown) through mud pulse telemetry or other remote communication system, as further described hereinbelow.

The logging while drilling means 28 is of a type known to those skilled in the art which contains instrumentation for logging subterranean zones or formations of interest during drilling. Generally, when a zone or formation of interest has been intersected by the well bore being drilled, the well bore is drilled through the zone or formation and the formation is logged while the drill string is being raised whereby the logging while drilling instrument is moved through the zone or formation of interest.

The logging while drilling tool may itself indicate that a zone or formation of interest has been intersected. Also, the operator of the drilling rig may independently become aware of the fact that a zone or formation of interest has been penetrated. For example, a drilling break may be encountered wherein the rate of drill bit penetration significantly changes. Also, the drilling cuttings circulating with the drilling fluid may indicate that a petroleum-bearing zone or formation has been intersected.

The logging while drilling means 28 provides constant remote communication with a surface command station by means of a remote communication system of a type described hereinbelow.

The drill bit 30 can be a conventional rotary drill bit and the drill string can be formed of conventional drill pipe. Preferably, the drill bit 30 includes a down hole drilling motor 36 for rotating the drill bit whereby it is not necessary to rotate the drill string. A particularly preferred arrangement is to utilize coiled tubing as the string 20 in combination with a steerable down hole drilling motor 36 for rotating the drill bit 30 and drilling the well bore in desired directions. When the drill string 18 is used for directional drilling, it preferably also includes a measuring while drilling means 37 for measuring the direction in which the well bore is being drilled. The measuring while drilling means 37 is of a type well known to those skilled in the art which provides constant remote communication with a surface command station.

Referring to FIGS. 1A–1D, and particularly FIG. 1A, the drill string 18 is shown extending through a conventional blow-out preventor stack 38 located at the surface 14. The drill string 18 is suspended from a conventional rotary drilling rig (not shown) in a well known manner. The drill string 18 is in a drilling position within the well bore 12, and it is shown after drilling the well bore through a first subsurface zone of interest 16. The packer 18 is in a retracted position and the tester valve 22 is in an open position so that drilling fluids may be circulated down through the drill string 18 and up through the annulus 34 in a conventional manner during drilling operations.

During drilling, the well bore 12 is typically filled with a drilling fluid which includes various additives including weighting materials whereby there is an overbalanced hydrostatic pressure adjacent the subsurface zone 16. The overbalanced hydrostatic pressure is greater than the natural formation pressure of the zone 16 so as to prevent the well from blowing out.

After the well bore 12 has intersected the subsurface zone 16, and that fact has become known to the drilling rig operator as result of a surface indication from the logging while drilling tool 28 or other means, the drilling is continued through the zone 16. If it is desired to test the zone 16 to determine if it contains hydrocarbons which can be produced at a commercial rate, a further survey of the zone 16 can be made using the logging while drilling tool 28. As mentioned above, to facilitate the additional logging, the drill string 20 can be raised and lowered whereby the logging tool 28 moves through the zone 16.

Thereafter, a variety of tests to determine the hydrocarbon production capabilities of the zone 16 can be conducted by operating the tester valve 22, the packer means 24 and the well fluid condition monitoring means 26. Specifically, the packer 24 is set whereby the well annulus 34 is sealed and the tester valve 22 is closed to close the drill string 18, as shown in FIG. 1B. This initially traps adjacent the subsurface zone 16 the overbalance hydrostatic pressure that was present in the annulus 34 due to the column of drilling fluid in the well bore 12. The fluids trapped in the well annulus 34 below packer 24 are no longer communicated with the column of drilling fluid, and thus, the trapped pressurized fluids will slowly leak off into the surrounding subsurface zone 16, i.e., the bottom hole pressure will fall-off. The fall-off of the pressure can be utilized to determine the natural pressure of the zone 16 using the techniques described in our copending application entitled Early Evaluation By Fall-Off Testing, designated as attorney docket number HRS 91.225B1, filed concurrently herewith, the details of which are incorporated herein by reference. As will be understood, the well fluid condition monitoring means 28 continuously monitors the pressure and temperature of fluids within the closed annulus 34 during the pressure fall-off testing and other testing which follows.

Other tests which can be conducted on the subsurface zone 16 to determine its hydrocarbon productivity include flow tests. That is, the tester valve 22 can be operated to flow well fluids from the zone 16 to the surface at various rates. Such flow tests which include the previously described draw-down and build-up tests, open flow tests and other similar tests are used to estimate the hydrocarbon productivity of the zone over time. Various other tests where treating fluids are injected into the zone 16 can also be conducted if desired.

Depending upon the particular tests conducted, it may be desirable to trap a well fluid sample without the necessity of flowing well fluids through the drill string to the surface. A means for trapping such a sample is schematically illustrated in FIG. 1C. As shown in FIG. 1C, a surge chamber receptacle 40 is included in the drill string 20 along with the other components previously described. In order to trap a sample of the well fluid from the subsurface zone 16, a surge chamber 42 is run on a wire line 44 into engagement with the surge chamber receptacle 40. The surge chamber 42 is initially empty or contains atmospheric pressure, and when it is engaged with the surge chamber receptacle 40, the tester valve 22 is opened whereby well fluids from the subsurface formation 16 flow into the surge chamber 42. The surge chamber 42 is then retrieved with the wire line 44. The surge chamber 42 and associated apparatus may, for example, be constructed in a manner similar to that shown in U.S. Pat. No. 3,111,169 to Hyde, the details of which are incorporated herein by reference.

After the subsurface zone 16 is tested as described above, the packer 24 is unset, the tester valve 22 is opened and drilling is resumed along with the circulation of drilling fluid through the drill string 20 and well bore 12.

FIG. 1D illustrates the well bore 12 after drilling has been resumed and the well bore is extended to intersect a second subsurface zone or formation 46. After the zone or formation 46 has been intersected, the packer 24 can be set and the tester valve 22 closed as illustrated to perform pressure fall-off tests, flow tests and any other tests desired on the subsurface zone or formation 46 as described above.

As will now be understood, the integrated well drilling and evaluation system of this invention is used to drill a well bore and to evaluate each subsurface zone or formation of interest encountered during the drilling without removing the drill string from the well bore. Basically, the integrated drilling and evaluation system includes a drill string, a logging while drilling tool in the drill string, a packer carried on the drill string, a tester valve in the drill string for controlling the flow of fluid into or from the formation of interest from or into the drill string, a well fluid condition monitor for determining conditions such as the pressure and temperature of the well fluid and a drill bit attached to the drill string. The integrated drilling and evaluation system is used in accordance with the methods of this invention to drill a well bore, to log subsurface zones or formations of interest and to test such zones or formations to determine the hydrocarbon productivity thereof, all without moving the system from the well bore.

Figure 2A:
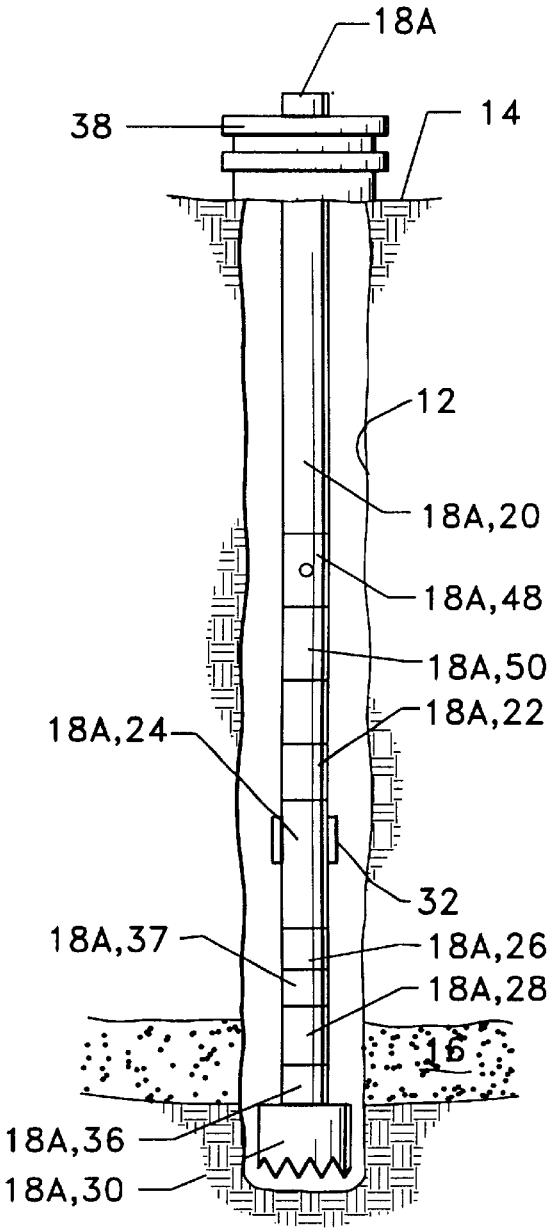
FIGS. 2A–2C comprise a sequential series of illustrations similar to FIGS. 1A–1C showing an alternative embodiment of the apparatus of this invention.
Figure 2B:
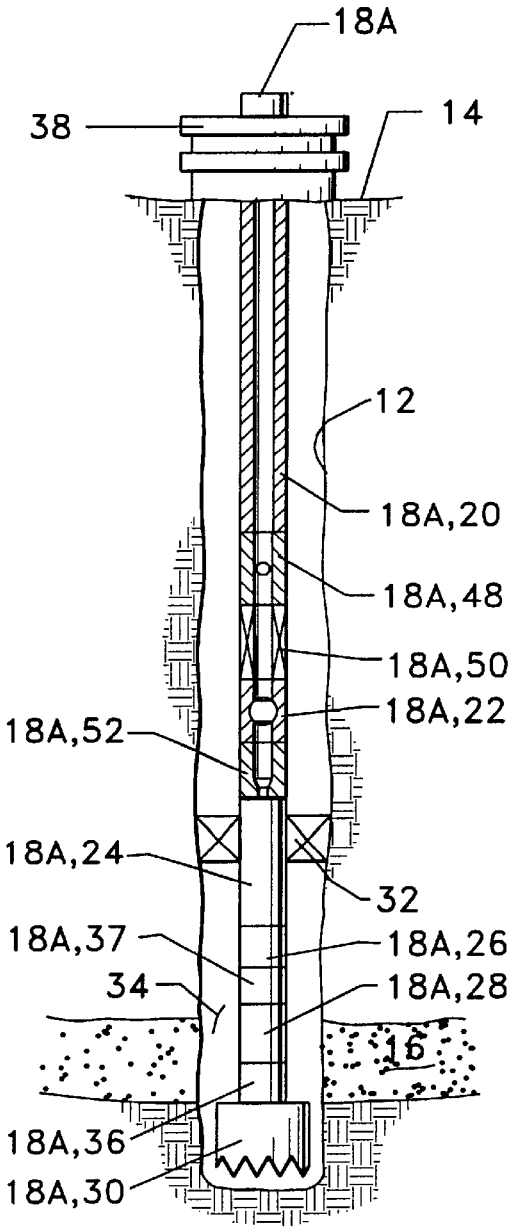
Figure 2C:
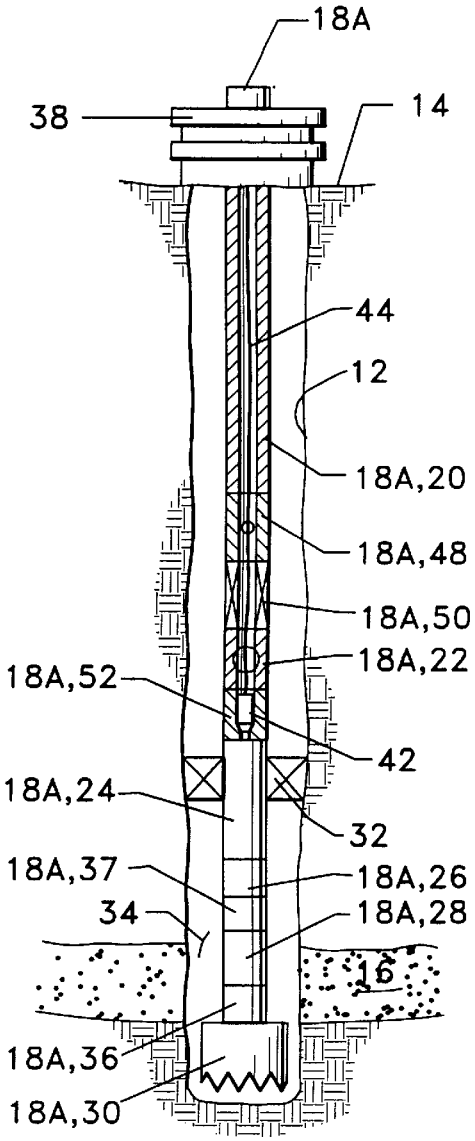

FIGS. 2A–2C are similar to FIGS. 1A–1C and illustrate a modified drill string 18A. The modified drill string 18A is similar to the drill string 18, and identical parts carry identical numerals. The drill string 18A includes three additional components, namely, a circulating valve 48, an electronic control sub 50 located above the tester valve 22 and a surge chamber receptacle 52 located between the tester valve 22 and the packer 24.

After the packer element 24 has been set as shown in FIG. 2B, the tester valve 22 is closed and the circulating valve 48 is open whereby fluids can be circulated through the well bore 12 above the circulating valve 48 to prevent differential pressure drill string sticking and other problems.

The tester valve 22 can be opened and closed to conduct the various tests described above including pressure fall-off tests, flow tests, etc. As previously noted, with any of the tests, it may be desirable from time to time to trap a well fluid sample and return it to the surface for examination. As shown in FIG. 2C, a sample of well fluid may be taken from the subsurface zone or formation 16 by running a surge chamber 42 on a wire line 44 into engagement with the surge chamber receptacle 52. When the surge chamber 42 is engaged with the surge chamber receptacle 52, a passageway communicating the surge chamber 42 with the subsurface zone or formation 16 is opened so that well fluids flow into the surge chamber 42. The surge chamber 42 is then retrieved with the wire line 44. Repeated sampling can be accomplished by removing the surge chamber, evacuating it and then running it back into the well.

Figure 3:
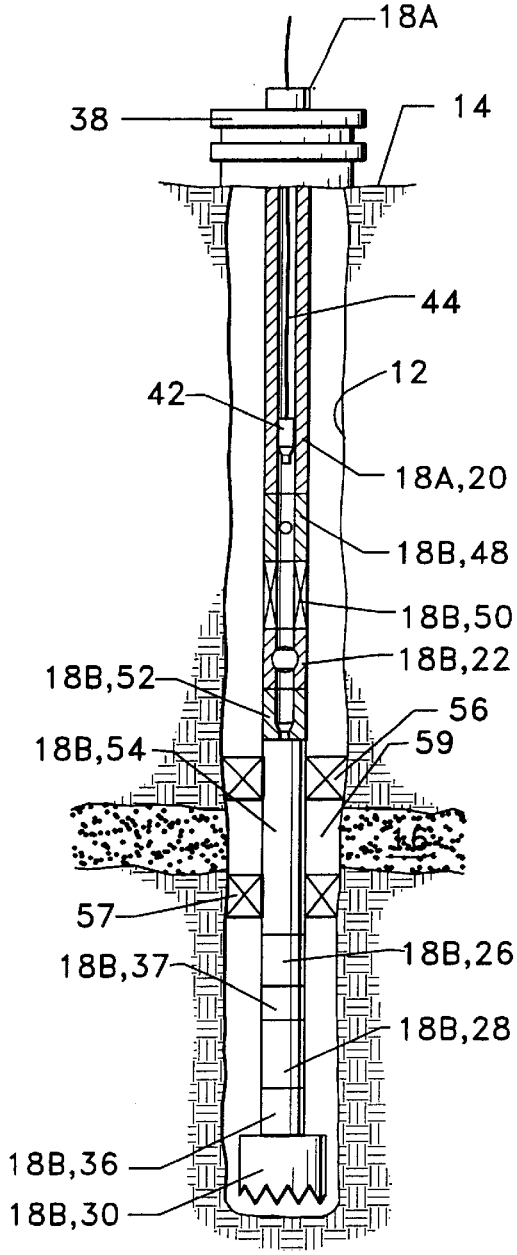
FIG. 3 is a schematic illustration of another alternative embodiment of the apparatus of this invention.

Referring now to FIG. 3 another modified drill string 18B is illustrated. The modified drill string 18B is similar to the drill string 18A of FIGS. 2A–2C, and identical parts carry identical numerals. The drill string 18B is different from the drill string 18A in that it includes a straddle packer 54 having upper and lower packer elements 56 and 57 separated by a packer body 59 having ports 61 therein for communicating the bore of tubing string 20 with the well bore 12 between the packer elements 56 and 57.

After the well bore 12 has been drilled and the logging while drilling tool 28 has been operated to identify the various zones of interest such as the subsurface zone 16, the straddle packer elements 56 and 57 are located above and below the zone 16. The inflatable elements 56 and 57 are then inflated to set them within the well bore 12 as shown in FIG. 3. The inflation and deflation of the elements 56 and 57 are controlled by physical manipulation of the tubing string 20 from the surface. The details of construction of the straddle packer 98 may be found in our copending application entitled Early Evaluation System, designated as attorney docket number HRS 91.225A1, filed concurrently herewith, the details of which are incorporated herein by reference.

Figure 4:
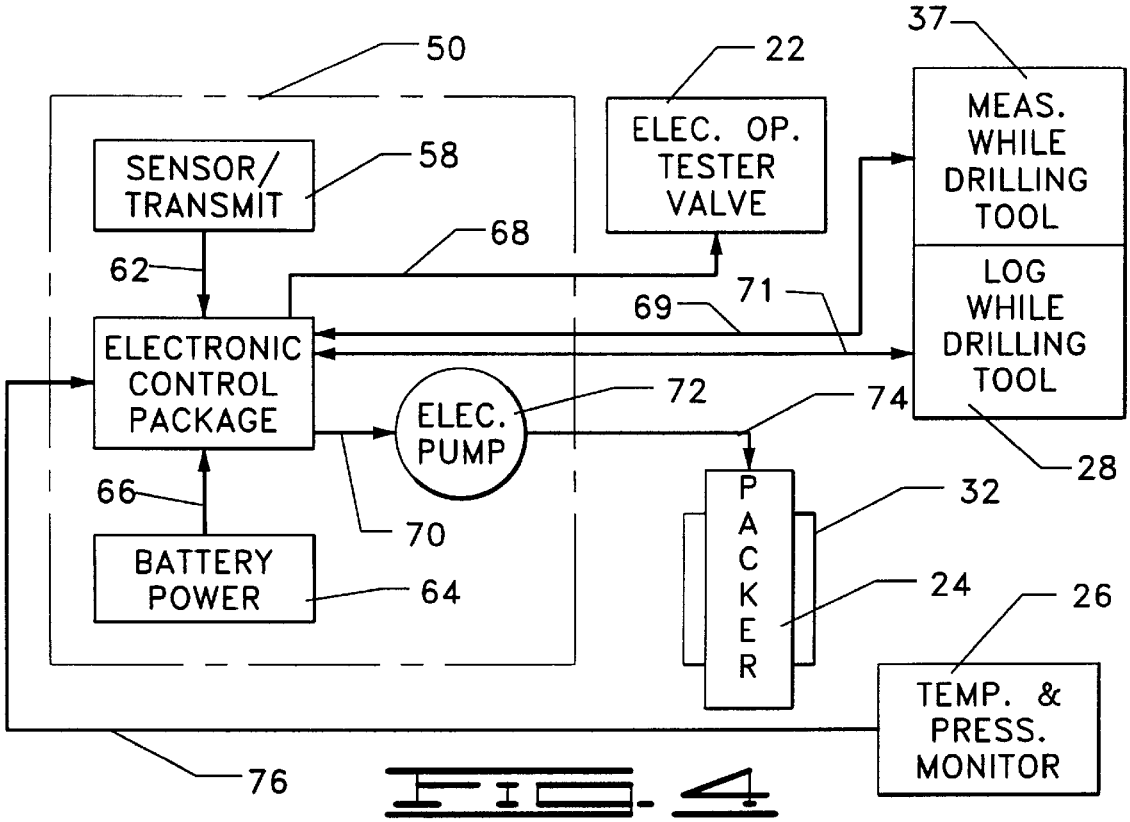
FIG. 4 is a schematic illustration of an electronic remote control system for controlling various tools in the drill string from a surface control station.

The drill strings 18A and 18B both include an electronic control sub 50 for receiving remote command signals from a surface control station. The electronic control system 50 is schematically illustrated in FIG. 4. Referring to FIG. 4, electronic control sub 50 includes a sensor transmitter 58 which can receive communication signals from a surface control station and which can transmit signals and data back to the surface control station. The sensor/transmitter 58 is communicated with an electronic control package 60 through appropriate interfaces 62. The electronic control package 60 may for example be a microprocessor based controller. A battery pack 64 provides power by way of power line 66 to the control package 60.

The electronic control package 60 generates appropriate drive signals in response to the command signals received by sensor/transmitter 58, and transmits those drive signals over electric lines 68 and 70 to an electrically operated tester valve 22 and an electric pump 72, respectively. The electrically operated tester valve 22 may be the tester valve 22 schematically illustrated in FIGS. 2A–2C and FIG. 3. The electronically powered pump 72 takes well fluid from either the annulus 34 or the bore of tubing string 20 and directs it through hydraulic line 74 to the inflatable packer 24 to inflate the inflatable element 32 thereof.

Thus, the electronically controlled system shown in FIG. 4 can control the operation of tester valve 22 and inflatable packer 24 in response to command signals received from a surface control station. Also, the measuring while drilling tool 37, the logging while drilling tool 28 and the well fluid condition monitor 26 may be connected with the electronic control package 60 over electric lines 69, 71 and 76, respectively, and the control package 60 can transmit data generated by the measuring while drilling tool 37, the logging while drilling tool 28 and the monitor 26 to the surface control station while the drill strings 18A and 18B remain in the well bore 12.

Figure 5:
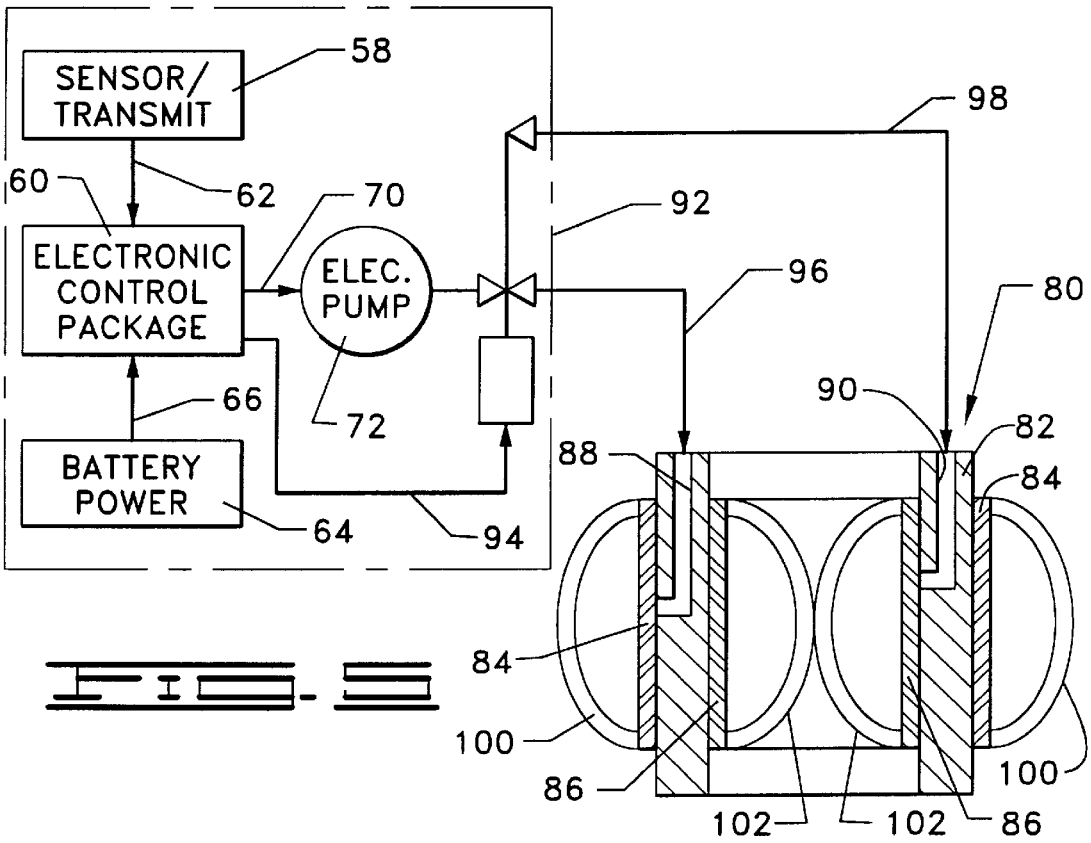
FIG. 5 is a schematic illustration similar to FIG. 4 which also illustrates a combination inflatable packer and closure valve.

FIG. 5 illustrates an electronic control sub 50 like that of FIG. 4 in association with a modified combined packer and tester valve means 80. The combination packer/closure valve 80 includes a housing 82 having an external inflatable packer element 84 and an internal inflatable valve closure element 86. An external inflatable packer inflation passage 88 defined in housing 82 communicates with the external inflatable packer element 84. A second inflation passage 90 defined in the housing 82 communicates with the internal inflatable valve closure element 86. As illustrated in FIG. 5, the electronic control sub 50 includes an electronically operated control valve 92 which is operated by the electronic control package 60 by way of an electric line 94. One of the outlet ports of the valve 92 is connected to the external inflatable packer element inflation passage 88 by a conduit 96, and the other outlet port of the valve 92 is connected to the internal inflatable valve closure inflation passage 90 by a conduit 98.

When fluid under pressure is directed through hydraulic conduit 96 to the passage 88, it inflates the external packer elements to the phantom line positions 100 shown in FIG. 5 so that the external packer element 84 seals off the well annulus 34. When fluid under pressure is directed through the hydraulic conduit 98 to the passage 90, it inflates the internal valve closure element 86 to the phantom line positions 102 shown in FIG. 5 so that the internal inflatable valve closure element 86 seals off the bore of the drill string 18. When fluid under pressure is directed through both the conduits 96 and 98, both the external packer element 84 and internal valve element 86 are inflated. Thus, the electronic control sub 50 in combination with the packer and valve apparatus 80 can selectively set and unset the packer 84 and independently selectively open and close the inflatable valve element 86.

As will be understood, many different systems can be utilized to send command signals from a surface location down to the electronic control sub 50. One suitable system is the signaling of the electronic control package 60 of the sub 50 and receipt of feedback from the control package 60 using acoustical communication which may include variations of signal frequencies, specific frequencies, or codes of acoustic signals or combinations of these. The acoustical transmission media includes tubing string, electric line, slick line, subterranean soil around the well, tubing fluid and annulus fluid. An example of a system for sending acoustical signals down the tubing string is disclosed in U.S. Pat. Nos. 4,375,239; 4,347,900; and 4,378,850 all to Barrington and assigned to the assignee of the present invention. Other systems which can be utilized include mechanical or pressure activated signaling, radio wave transmission and reception, microwave transmission and reception, fiber optic communications, and the others which are described in our copending application entitled Early Evaluation By Fall-Off Testing, designated as attorney docket number HRS 91.225B1, filed concurrently herewith, the details of which are incorporated herein by reference.

Thus, the apparatus and methods of the present invention achieve the ends and advantages mentioned as well as those which are inherent therein. While certain preferred embodiments of the invention have been described and illustrated for purposes of this disclosure, numerous changes may be made by those skilled in the art which are encompassed with the scope and spirit of the present invention as defined by the appended claims.

What is claimed is:

1. An integrated well drilling and evaluation system for drilling and logging a well and testing in an uncased well bore portion of the well, comprising:

a drill string;

a drill bit, carried on a lower end of said drill string, for drilling the well bore;

logging while drilling means, included in said drill string, for generating data indicative of the nature of subsurface formations intersected by said uncased well bore, so that a formation or zone of interest may be identified without removing said drill string from said well;

a packer, carried on sail drill string above said drill bit, having a set position for sealingly closing a well annulus between said drill string and said uncased well bore above said formation or zone of interest and having an unset position such that said drill bit may be rotated to drill said well bore, said packer being selectively positionable between said set position and said unset position; and testing means, included in said drill string, for controlling flow of fluid between said formation and said drill string when said packer is in said set position;

whereby, said well can be selectively drilled, logged and tested without removing said drill string from said well.

2. The system of claim 1, further comprising:

a circulating valve, included in said drill string above said testing means.

3. The system of claim 1, wherein:

said testing means includes a closure valve for communicating said formation of interest with the interior of said drill string.

4. The system of claim 1, wherein said testing means comprises:

a surge receptacle included in said drill string;

a surge chamber means, constructed to mate with said surge receptacle, for receiving and trapping a sample of said well fluid therein; and retrieval means for retrieving said surge chamber means back to a surface location while said drill string remains in said well bore.

5. The system of claim 1, further comprising:

a downhole drilling motor, included in said drill string and operably associated with said drill bit, for rotating said drill bit to drill said well bore.

6. The system of claim 5, wherein said downhole drilling motor is a steerable downhole drilling motor means.

7. The system of claim 5, further comprising:

measuring while drilling means, included in said drill string, for measuring a direction of said well bore.

8. The system of claim 1, further comprising:

monitoring means for monitoring a parameter of said well fluid.

9. The system of claim 1, wherein said packer includes a straddle packer.

10. The system of claim 1, wherein said packer includes an inflatable packer.

11. The system of claim 1, wherein:

said drill string is a coiled tubing drill string.

12. An integrated drilling and evaluation system for drilling and logging a well and testing in an uncased well bore of the well, comprising:

a drill string;

a drill bit, carried on a lower end of said drill string, for drilling the well bore;

a packer, carried on said drill string above said drill bit, for sealing a well annulus between said drill string and said uncased well bore above said drill bit means;

a surge receptacle included in said drill string;

surge chamber means, constructed to mate with said surge receptacle, for receiving and trapping a sample of well fluid therein;

retrieval means for retrieving said surge chamber back to a surface location while said drill string remains in said uncased well bore;

logging while drilling means, included in said drill string, for generating data indicative of the nature of subsurface zones or formations intersected by said uncased well bore; and a circulating valve included in said drill string above said surge receptacles.

13. The system of claim 12, further comprising:

measuring while drilling means, included in said drill string, for measuring a direction of said well bore.

14. The system of claim 12, further comprising:

pressure and temperature monitoring means for measuring and recording pressure and temperature data for said well fluid.

15. An integrated drilling and evaluation system for drilling and logging a well and testing in an uncased well bore portion of the well, comprising:

a drill string;

a drill bit, carried on a lower end of said drill string, for drilling said well bore;

a packer for sealing a well annulus between said drill string and said uncased well bore above said drill bit, said packer being selectively positionable between set and unset positions;

a valve, included in said drill string, for controlling the flow of fluid between said well bore below said packer and said drill string when said packer is in said set position;

logging while drilling means, included in said drill string, for logging subsurface zones or formations intersected by said uncased well bore; and a circulating valve included in said drill string above said valve.

16. The system of claim 15, further comprising:

measuring while drilling means, included in said drill string, for measuring a direction of said well bore.

17. The system of claim 15, further comprising:

well fluid condition monitoring means for measuring and recording pressure and temperature data for said well fluid.

18. The system of claim 15, wherein said drill string is a coiled tubing drill string.

19. The system of claim 15, further comprising:

downhole motor for rotating said drill bit.

20. The system of claim 15, wherein said packer includes a straddle packer.

21. A method of early evaluation of a well having an uncased well bore intersecting a subsurface zone or formation of interest, comprising:

(a) providing a testing string in said well bore including:
a tubing string;
a logging tool included in said tubing string;
a packer carried on said tubing string; and
a fluid testing device included in said tubing string;

(b) logging said well with said logging tool and thereby determining the location of said subsurface zone or formation of interest;

(c) without removing said testing string from said well bore after step (b), setting said packer in said well bore above said subsurface formation and sealing a well annulus between said testing string and said well bore; and (d) flowing a sample of well fluid from said subsurface formation below said packer to said fluid testing device.

22. The method of claim 21, wherein:

in step (a), said testing string is a drill string further including a drill bit carried on a lower end of said drill string;

step (a) includes drilling said well bore with said drill bit; and step (b) is performed without removing said drill string from said well bore after said drilling step.

23. The method of claim 22, wherein:

in step (a), said drill string further includes a steerable downhole drilling motor and a measuring while drilling tool;

step (a) includes rotating said drill bit with said steerable downhole drilling motor to drill said well bore; and said method further comprises:

measuring a direction of said well bore with said measuring while drilling tool.

24. The method of claim 22, wherein:

in step (a), said drill string further includes:

a circulating valve located above said fluid testing device; and said fluid testing device is a flow tester valve for controlling flow of well fluid through said tubing string; and step (d) includes opening said flow tester valve and flowing said sample of said well fluid up through said drill string to a surface location to flow test said well.

25. The method of claim 22, wherein:

in step (a), said fluid testing device includes a surge receptacle included in said drill string and a surge chamber constructed to mate with said surge receptacle; and step (d) includes:

running said surge chamber into said drill string;

mating said surge chamber with said surge receptacle;

flowing said fluid sample into said surge chamber; and retrieving said surge chamber while said drill string remains in said well bore.

26. The method of claim 25, wherein:

in step (a) said drill string further includes a circulating valve located above said fluid testing device; and said method further comprises during step (d):

opening said circulating valve; and circulating fluid through said well annulus above said packer to prevent differential sticking of said tubing string in said open well bore.

27. An integrated drilling and evaluation apparatus for drilling a well and testing in an uncased well bore of a well, comprising:

a drill string;

a drill bit, carried on a lower end of the drill string, for drilling the well bore;

a packer, carried on the drill string above the drill bit, for sealing against the uncased well bore when in a set position and thereby isolating at least a portion of a formation or zone of interest intersected by the well bore and for disengaging the uncased well bore when in an unset position, thereby allowing fluid flow between the packer and the uncased well bore when the drill bit is being used for drilling the well bore;

a fluid monitoring system, included in the drill string, for determining fluid parameters of fluid in the formation or zone of interest; and a tester valve, included in the drill string, for controlling flow of fluid from the formation or zone of interest into the drill string when the packer is in the set position;

wherein, the well can be selectively drilled and tested without removing the drill string from the well.

28. The apparatus of claim 27, wherein the tester valve comprises a closure valve for communicating the formation or zone of interest with an interior portion of the drill string.

29. The apparatus of claim 27, further comprising:

a surge receptacle included in the drill string; and a retrievable surge chamber, constructed to mate with the surge receptacle, for receiving and trapping a sample of well fluid therein.

30. The apparatus of claim 27, further comprising:

a downhole drilling motor, included in the drill string and operatively associated with the drill bit, for rotating the drill bit to drill the well bore.

31. The apparatus of claim 30, wherein the downhole drilling motor is steerable.

32. The apparatus of claim 30, further comprising a measuring while drilling system, included in the drill string, for measuring a direction of the well bore as the drill bit is rotated.

33. The apparatus of claim 27, wherein:

the drill string is a coiled tubing drill string.

34. The apparatus of claim 27 wherein the fluid monitoring system is adapted for selectively measuring temperature and pressure of the fluid.

35. The apparatus of claim 27 further comprising a logging while drilling tool, included in the drill string, for generating data indicative of the nature of subsurface formations or zones of interest intersected by the well bore.

36. The apparatus of claim 27 wherein:

the set position of the packer sealingly engages the uncased well bore and thereby seals a well annulus between the drill string and the uncased well bore above the formation or zone of interest; and the unset position is disengaged from the uncased well bore and allows fluid flow through the annulus when the drill bit is drilling the well bore.

37. The apparatus of claim 27 wherein:

the packer is a straddle packer for sealing on opposite sides of the formation or zone of interest.

38. The apparatus of claim 27 wherein:

the packer is an inflatable packer.

39. The apparatus of claim 27 wherein:

the fluid monitoring system provides remote communication with a surface command station through telemetry.

40. A method of early evaluation of a well having an uncased well bore, comprising the steps of:

(a) providing a drilling and testing string comprising:

a drill bit;

a packer for sealingly engaging the well bore; and a well fluid condition monitor;

(b) drilling the well bore with the drill bit until the well bore intersects a formation or zone of interest;

(c) without removing the drilling and testing string from the well after step (b), effecting a seal with the packer against the uncased well bore and thereby isolating at least a portion of the formation or zone of interest; and (d) without removing the drilling and testing string from the well bore, determining, with the well fluid condition monitor, fluid parameters of fluid in the formation or zone of interest.

41. The method of claim 40 wherein step (d) comprises flowing fluid from the formation or zone of interest into the drilling and testing string.

42. The method of claim 41, wherein:

in step (a), the drilling and testing string further comprises a fluid testing device; and the step of flowing fluid comprises flowing a sample of fluid from the subsurface formation or zone of interest to the well testing device.

43. The method of claim 42, wherein:

in step (a), the drilling and testing string further comprises a circulating valve located above the fluid testing device;

the fluid testing device is a flow tester valve for controlling flow of well fluid through the tubing string; and step (d) further comprises opening the flow tester valve and flowing the sample of well fluid up through the drilling and testing string to a surface location to flow test the well.

44. The method of claim 41, wherein:

in step (a), the drilling and testing string comprises a surge receptacle; and the step of flowing fluid comprises:

running a surge chamber constructed to mate with the surge receptacle into the drilling and testing string;

mating the surge chamber with the surge receptacle;

flowing fluid from the surge chamber; and retrieving the surge chamber while the drilling and testing string remains in the well bore.

45. The method of claim 44, wherein:

in step (a), the drilling and testing string further comprises a circulating valve located above the well fluid testing device; and said method further comprises:

(e) opening the circulating valve; and (f) circulating fluid above the packer to prevent differential sticking of the drilling and testing string in the uncased well bore.

46. The method of claim 45 wherein steps (e) and (f) are carried out during step (d).

47. The method of claim 40 wherein step (d) is carried out after steps (b) and (c).

48. The method of claim 40 wherein the step of determining fluid parameters comprises determining a pore pressure of the formation or zone of interest.

49. The method of claim 40 wherein the step of determining fluid parameters comprises determining a temperature of the fluid.

50. The method of claim 40, wherein:

in step (a), the drilling and testing string further comprises a steerable downhole drilling motor; and step (b) further comprises rotating the drill bit with the downhole steerable drilling motor.

51. The method of claim 50, wherein:

in step (a), the drilling and testing string further comprises a measuring while drilling tool; and step (b) further comprises measuring a direction of the well bore with the measuring while drilling tool.

52. The method of claim 40, wherein:

in step (a), the drilling and testing string further comprises a logging tool; and step (b) further comprises logging the well with the logging tool to determine the location of the formation or zone of interest.

53. The method of claim 40, wherein:

step (c) comprises setting the packer in the uncased well bore adjacent the formation or zone of interest and sealing a well annulus between the drilling and testing string and the uncased well bore.

54. The method of claim 53, wherein:

the packer is a straddle packer having spaced packer elements thereon; and step (c) comprises setting the straddle packer in the uncased well bore such that the portion of the formation or zone of interest is between the packer elements of the packer.

* * * * *